United States Patent [19]

Baravian

[11] Patent Number: 4,560,385

[45] Date of Patent: Dec. 24, 1985

[54] PROCESS FOR THE TREATMENT OF NON-WOVEN SHEETS AND THE PRODUCT OBTAINED

[75] Inventor: Jean Baravian, Croissy sur Seine, France

[73] Assignee: Rhone-Poulenc Fibres, Lyons, France

[21] Appl. No.: 612,345

[22] Filed: May 21, 1984

[30] Foreign Application Priority Data

May 25, 1983 [FR] France ..... 83 08770

[51] Int. Cl.[4] ..... D06M 9/00; D02G 3/00

[52] U.S. Cl. ..... 8/115.7; 264/171; 428/373; 428/374

[58] Field of Search ..... 8/115.7, 130.1; 264/343, 168, 171; 428/373, 374

[56] References Cited

U.S. PATENT DOCUMENTS

| | | | |
|---|---|---|---|
| 3,117,906 | 1/1964 | Tanner | 428/397 |
| 3,616,504 | 11/1971 | Otto | 8/130.1 |
| 3,718,534 | 2/1973 | Okamoto | 428/394 |
| 4,150,674 | 4/1979 | Yung | 428/373 |
| 4,280,860 | 7/1981 | Shen | 264/168 |
| 4,460,649 | 7/1984 | Park | 264/171 |

FOREIGN PATENT DOCUMENTS

| | | | |
|---|---|---|---|
| 7004351 | 9/1970 | Netherlands | 428/373 |

*Primary Examiner*—Theodore Morris
*Attorney, Agent, or Firm*—Sherman & Shalloway

[57] ABSTRACT

A process for the treatment of non-woven sheets made of synthetic textiles containing two constituents arranged side-by-side, one based on polyamide (polyhexamethyleneadipamide) and the other based on polyester (polyethylene glycol terephthalate), in which the following steps are carried out: (a) conversion to a sheet of the crimped textile having an overall linear density of less than 2 dtex, (b) optional needle bonding of the sheet, and (c) chemical treatment at low temperature in an aqueous solution of a swelling product for one of the constituents, permitting contraction and at least partial separation of the two constituents of the textile, the strands of which each then have a denier of less than 1 dtex. Swelling product: aqueous solution of formic acid at a concentration of 50% to 70%, preferably of between 55% and 65%, and at a temperature of between 5° C. and 40° C., preferably of between 18° C. and 25° C.

The non-woven sheets obtained, having characteristics enabling them to be used in the majority of textile applications such as clothing, furnishing and the like.

10 Claims, No Drawings

PROCESS FOR THE TREATMENT OF NON-WOVEN SHEETS AND THE PRODUCT OBTAINED

The present Application relates to a process for the treatment of non-woven sheets in which the textiles are two-component, and also to the products obtained.

Non-woven sheets are well known; they are manufactured using either the wet process or the dry process or melt process.

In the wet process, the fibres are, for example, suspended in a liquid containing products which facilitate their bonding, and they are then collected into a sheet, calendered and dried. In the dry process, the sheets consist of chopped, carded fibres converted to a web, the sheet comprising at least one thickness of fibrous web, and are then treated to give them cohesion. It is also known to produce by the dry process sheets of continuous threads alternated by special processes. In the melt process, the sheet is obtained by the extrusion of synthetic polymers in the form of bundles of continuous filaments, which are separated and converted to a sheet on an endless apron, and the sheet is then sized by calendering and optionally needle-bonded.

The sheets obtained by the melt process are generally made of synthetic textiles containing a single constituent such as polyethylene glycol terephthalate or polypropylene; sheets have been proposed which contain several constituents having different adhesive bonding temperatures, so as to make it possible to bond the filaments under the action of heat and pressure.

The present Application relates more particularly to the nonwovens obtained from synthetic textiles containing two constituents in the form of strands, or continuous filaments, the two constituents being arranged side-by-side. The principal applications of the non-woven sheets obtained by the melt process are generally in building and civil engineering, this being on account of their imputrescibility and their ability to drain, filter, spread loads and separate layers of ground, in which they are used for stabilization as described, for example, in French Pat. No. 1,601,049 of the Applicant Company. They have also been used as wall coverings or as floor coverings or carpet underlay, but they are not generally used for clothing and furnishing applications, for example. In fact, for this purpose, they must have suppleness, a good feel and a homogeneity of structure with a low weight per square meter, and these characteristics are not generally obtained under the normal conditions of manufacture for the principal uses above. Inter alia, the nonwovens should be composed of filaments having very fine deniers in order to give them suppleness, for example.

Processes for the manufacture of filaments having fine deniers appeared a few years ago.

Also, U.S. Pat. No. 3,117,906 proposes products containing two constituents arranged side-by-side, which can be separated by contact with boiling water and mechanical treatment, the woven and knitted fabrics obtained having a silky appearance.

French Pat. No. 1,513,531 proposes a process for the production of composite filaments, some of which are based on polyamide/polyester, which process, after removal of one of the constituents, makes it possible to obtain very fine continuous filaments; thus, provision is made in the said patent for the filaments to be able to be converted to woven fabrics, knitted fabrics or nonwoven strips, which are then subjected to the action of a suitable solvent for one of the constituents, the other constituent then remaining on its own in the woven or knitted fabric or nonwoven.

It has also been proposed, in Japanese patent application No. 56/49,077, to produce composite polyamide/polyester filaments and then to chop them into fibres, which are then coverted to a sheet by the dry process, the resulting sheet is needle-bonded and then impregnated with an aqueous solution of a product chosen from the group comprising phenol, benzyl alcohol and phenolic alcohol, and the sheet treated in this way is then subjected to steam at a temperature above 70 ®, which enables the polyamide fibres to contract and the two constituents to separate, the final nonwoven having only polyester fibres on the surface.

In Japanese patent application No. 56/31,380, provision is made for a process for the production of a nonwoven which comprises the following steps:

extrusion of composite threads, chopping into fibres, carding and production of sheets, needle bonding, which causes some of the fibres to separate mechanically into their two constituents, and then heat treatment with boiling water, which causes complete separation of the constituents.

In these Applications, the solvent treatment or the needle bonding is followed by a heat treatment, for example with steam or boiling water, and the combination of these two treatments causes complete separation of the constituents and contraction of the fibrous sheet.

The present Application proposes a process which makes it possible to simplify these procedures.

The present invention relates to a process for the treatment of non-woven sheets produced from fibres or continuous filaments made of synthetic textile and containing two constituents arranged side-by-side, characterized in that the following steps are carried out:

a. conversion to a sheet of the crimped textile having an overall linear density of less than 2 dtex, b. optional needle bonding of the sheet, and c. chemical treatment at low temperature in an aqueous solution of a swelling product for one of the constituents, permitting contraction and at least partial separation of the two constituents of the textile, the strands of which each then have a denier of less than 1 dtex.

The constituents arranged side-by-side are made of any polymer, copolymer or a mixture of these; they are obtained by the known extrusion processes. The cross-section of the strands can have any shape, such as round, crescent-shaped or multilobular, and the constituents are distributed over the cross-section in quarters, etc. The constituents behave differently in subsequent treatments such as, for example, heat treatments or chemical treatments.

The crimping generally occurs by virtue of the different behaviour of each of the constituents, for example during the cooling of the filaments after extrusion beyond the outlet of the die, this cooling being effected uniformly or alternatively in an asymmetrical manner. The sheet can be obtained by the dry process from fibres obtained by pairing filaments, or by the melt process from continuous filaments. The product which makes it possible to swell one of the constituents depends on the latter.

The present Application will generally but not necessarily refer to textile sheets in which the constituents are a polyamide and a polyester. Preferably, polyethylene glycol terephthalate will be used as the polyester and the polycondensation product of hexamethylenediamine and adipic acid will be used as the polyamide. The overall denier of the textiles containing two constituents is preferably less than 2 dtex. As regards possible needle bonding, its intensity and the nature of the needles depend on the final result which it is desired to obtain. If needle bonding is carried out on the sheets, which, in the Application, have a weight per square meter of 40 g/m$^2$ to 400 g/m$^2$, this operation will preferably be performed with needles having the following characteristics: gauge: 38 to 42, preferably 40 or 42, possessing 2 to 3 barbs smoothed on 2 or 3 edges, the latter being triangular or quadrangular. The number of perforations per square centimeter is preferably between 100 and 1500 and more preferably from 400 to 800.

The present Application also relates to the treated sheets of the present Application, produced from polyethylene glycol terephthalate and polyhexamethyleneadipamide and also having a tear strength of more than 25 g/m$^2$, a flexural strength of between 300 and 2500 mg/cm of width, an abrasion resistance of more than 500 cycles, a residual deformation with time, under an elongation load of 5 daN, which is in a ratio of 1 to 4 compared with a needle-bonded sheet of the same weight after mechanical fatigue of 50 cycles, and a zero residual deformation with time after simple elongation under a load of 5 daN.

For the treatment in a swelling medium, it is possible to use a swelling agent for the polyamide or for the polyester; for example, it will be possible to use formic acid, phenol, benzyl alcohol or methylene chloride at concentrations which depend on the product and the given treatment temperature, which depend on the desired effect on the nonwoven: the greater the concentration and the higher the temperature, the greater the contraction is and the less supple the nonwoven remains. For the treatment of the polyamide in a medium containing formic acid, it will be preferred to use aqueous solutions at concentrations of between 50 and 70%, at a temperature of between ambient temperature and 40° C., preferably of between 18° and 25° C. It has thus been found that only treatment in a swelling medium for the nonwoven at a relatively low temperature makes it possible both to contract the sheets and to separate the constituents, and to give the nonwoven the desired characteristics of suppleness and feel, without it being necessary to include a treatment at high temperature in an aqueous medium or steam, whereas in the prior art, it was the combination of these two operations, namely treatment with a solvent or swelling agent and treatment in an aqueous medium or steam at high temperature, which permitted contraction and the separation of the two constituents. For the chemical contraction treatment in a solution of swelling agent, it will be preferred to use the following procedure: treatment with a solution of formic acid, draining, washing, rinsing, draining and drying, preferably drying in vacuo, at high frequency, in a medium and at a temperature which has little or no effect on the mechanical characteristics and the presentation of the product; of course, it is possible, if desired, subsequently to dry the product at higher temperatures, depending on the desired effect, these operations preferably being carried out continuously.

The sheets treated in this way are supple, dense and isotropic, they have drape and a good feel and they remain permeable. They have better mechanical fatigue and elasticity than identical needle-bonded but untreated sheets. Thus, the treated sheets show, on the one hand, a mechanical fatigue in the longitudinal direction and transverse direction of 60 to 80% compared with the untreated sheet, whereas the latter, under the same conditions of measurement, has 40 to 45% mechanical fatigue in the longitudinal direction and 35 to 40% in the transverse direction, and, on the other hand, a virtually zero residual deformation with time, whereas for the uncontracted sheet, the residual deformation measured still detracts from the strength of the sheet. The characteristics of porosity to air, automatic crease recovery and resistance to pilling, and also the tests relating to "wash and wear" and resistance to washing and repeated rubbing, are comparable to those observed for traditional woven fabrics. The sheets can optionally be coloured continuously, for example by low-temperature dyeing, or alternatively printed by transfer printing, this operation being carried out on rollers at a temperature of 210° C.; obviously, provision can be made initially for colouring the two constituents in bulk before they are extruded.

The sheets thus obtained can be used for numerous textile applications such as furnishing (hangings, wall coverings, seats, counterpanes, blankets and the like) and clothing (dresses, coats, tailored suits, jackets, trousers, hats and the like); they can be used for more technical applications such as leather working (coating substrate, lining and the like), shoes (warm lining, slippers), soft trim for cars, and travel goods, for example artificial suede and leather, after impregnation with resin; these are thus excellent bases for the production of imitation leather products after impregnation with flexible resins such as polyurethane.

In the examples which follow, the characteristics are measured in the following manner:

breaking load and elongation: according to French Standard G 07 001 tear strength: according to French Standard G 07 055 flexural strength: ISO recommendation TC 94/SC 1139 F 3/70 coefficient of drape: French Standard G 07 109 abrasion resistance: French Standard GT 46 012, using the abrasive 734 from MINNESOTA MINING AND MANUFACTURING CO.

The residual deformation with time, without fatigue, is measured after the elongation, under 5 daN, of a test piece of width 5 cm and length 20 cm, between jaws, in the following manner: the elongation at time zero is measured and the sample is then allowed to return, giving the residual deformation at time zero, and this deformation is then measured with time, the measurement being carried out by way of comparison on an untreated sheet and on a treated sheet. The residual deformation with time, after mechanical fatigue of 50 cycles, is carried out in the same way as previously, after elongation under a load of 5 daN, by means of an Adamel Lhomergy DY 22 tensile tester (traction speed 50 mm/minute), but the fatigue is measured under constant elongation.

The examples which follow illustrate the present Application without limiting it.

EXAMPLE 1

A non-woven sheet of 125 g/m$^2$ is produced using the process and device forming the subject of French Pat. No. 2,299,438 of the Applicant Company, under the following conditions: extrusion of 132 filaments of 1.5 dtex, each consisting of two constituents, one a polyamide (polyhexamethyleneadipamide) and the other a polyester (polyethylene glycol terephthalate), arranged side-by-side, and stretching through a nozzle forming the subject of French Pat. No. 1,582,147 of the Applicant Company, air pressure: $3.10^5$ Pa, located 130 cm from the die, speed of the endless apron for taking up and conveying the sheet formed: 1 m/minute for a sheet width of 95 cm.

The sheet is then sized in respect of thickness by passage between two metal rollers heated to 168° C., with a force of pressure of 2 daN per cm of width, and is then fed into a needle-felting machine equipped with needles of the following type: SINGER, gauge 2, 2 barbs, 2 edges, needle bonding at 600 perforations/$cm^2$; the needle-bonded sheet is then treated at a temperature of 18° C. with an aqueous solution containing 61% of formic acid, for 3 minutes, rinsed with running water and drained, the contracted and separated constituents each having a denier of 0.75 dtex, and the sheet is then dried at 120° C. in air for 5 minutes.

The sheet obtained is supple; its characteristics are given below in Table II by comparison with those of the untreated sheet (Table I); it has a very soft feel and a good drape and it weighs 170 g/$m^2$.

EXAMPLES 2 TO 4

The procedure of Example 1 is followed and the sheet is then treated with formic acid, the polyamide constituent again being treated as in the said example.

The conditions under which the sheet is obtained, and the characteristics, are collated in Table II below by comparison with the characteristics of the untreated sheet (Table I).

EXAMPLE 5

The procedure of Example 1 is followed to produce a sheet of composite filaments of denier 2 dtex, side-by-side arrangement, 50/50 polyhexamethyleneadipamide/polyethylene glycol terephthalate, weight 110 grams/$m^2$, speed of the take-up apron 1.13 m/minute for a sheet width of 95 centimeters. The said sheet then passes between two metal calendering rollers, one of which is heated to 232° C. and engraved in relief with a truncated pyramid motif having a square grain surface of side length 0.77 mm, the arrangement of the squares being such that there is a distance of 0.95 mm between protuberances, and one of the diagonals of the squares being located along the axis of the sheet, and the lower roller, called the counterroller, is smooth and heated to a temperature of 217° C., the speed of passage of the sheet between the rollers being 15 m/minute and the force of pressure being 50 daN per linear centimeter of calender width. The spot-bonded sheet is then treated at a temperature of 30° C. in a 68% aqueous solution of formic acid, the strands contract and separate into two constituents each of 1 dtex, and the sheet is then rinsed and drained and weighs 165 g/$m^2$ after drying; it has the characteristics indicated in Table II below and it is supple and has a very soft feel and a good drape.

TABLE I of the characteristics of the sheets before treatment.

| | Ex. 1 | Ex. 2 | Ex. 3 | Ex. 4 |
|---|---|---|---|---|
| Weight of the needle-bonded sheet (g/$m^2$) | 125 | 161.6 | 124.8 | 124.8 |
| Thickness (mm) | 1.15 | 1.35 | 1.12 | 1.12 |
| Breaking load, longitudinal direction, daN | 30.9 | 38.4 | 33 | 33 |
| Breaking load, transverse direction, daN | 39 | 45.3 | 35.5 | 35.5 |
| Elongation at break, longitudinal direction (%) | 103.9 | 108.2 | 102.9 | 102.9 |
| Elongation at break, transverse direction (%) | 99 | 109.7 | 100.7 | 100.7 |
| Tear strength, longitudinal direction, daN | 5.8 | 8.2 | 5.9 | 5.9 |
| Tear strength, transverse direction, daN | 5.1 | 7.7 | 5.8 | 5.8 |
| Flexural strength, longitudinal direction (mg/cm) | 1 175 | 1 907 | 1 221 | 1 221 |
| Flexural strength, transverse direction (mg/cm) | 1 353 | 2 072 | 1 233 | 1 233 |
| Average flexural strength (mg/cm) | 1 262 | 1 988 | 1 227 | 1 227 |
| Coefficient of drape | 0.9772 | 0.9834 | 0.9831 | 0.9831 |
| Abrasion resistance (cycles) | 188 | 236 | 90 | 90 |

TABLE II of the conditions for obtaining the sheets and characteristics of the sheets after treatment.

| | Ex. 1 | Ex. 2 | Ex. 3 | Ex. 4 | Ex. 5 |
|---|---|---|---|---|---|
| Denier of the extruded filaments (dtex) | 1.5 | 2 | 1.5 | 1.5 | 2 |
| Weight of the sheet (g/$m^2$) | 125 | 150 | 125 | 125 | 110 |
| Speed of the endless apron (m/minute) | 1 | 1.10 | 1 | 1 | 1.50 |
| Width of the sheet (cm) | 95 | 95 | 95 | 95 | 95 |
| Type of needle | SINGER 42 2B2E | SINGER 42 2B2E | SINGER 42 2B2E | SINGER 42 2B2E | — — |
| Number of perforations/ $cm^2$ | 600 | 650 | 600 | 600 | — |
| Weight of the needle-bonded sheet (g/$m^2$) | 135 | 165 | 135 | 135 | — |
| Proportion of formic acid in the aqueous solution (%) | 61 | 64.5 | 59.1 | 66.6 | 68 |
| Denier of the separated strands | 0.75 | 1 | 0.75 | 0.75 | 1 |
| Weight of the finished sheet (g/$m^2$) | 170 | 230 | 160 | 190 | 165 |
| Thickness (mm) | 0.99 | 1.35 | 1 | 1.2 | 0.71 |
| Breaking load, longitudinal direction, daN | 35 | 57.5 | 38.4 | 44.7 | 35 |
| Breaking load, transverse direction, daN | 41.2 | 53.7 | 40.5 | 41.8 | 33 |
| Elongation at break, longitudinal direction (%) | 99.1 | 110 | 102.5 | 114 | 69 |
| Elongation at break, transverse direction (%) | 100.7 | 115 | 102.8 | 119.7 | 72 |
| Tear strength, longitudinal direction, daN | 4.1 | 6.35 | 4 | 4.1 | 5.5 |
| Tear strength, transverse direction, daN | 3.7 | 6.15 | 3.9 | 4.1 | 4.1 |
| Flexural | 874 | 2 523 | 880 | 1 783 | 2 917 |

TABLE II-continued

| of the conditions for obtaining the sheets and characteristics of the sheets after treatment. | Ex. 1 | Ex. 2 | Ex. 3 | Ex. 4 | Ex. 5 |
|---|---|---|---|---|---|
| strength, longitudinal direction (mg/cm) | | | | | |
| Flexural strength, transverse direction (mg/cm) | 567 | 1 232 | 321 | 1 147 | 1 733 |
| Average flexural strength (mg/cm) | 709 | 1 801 | 399 | 1 442 | 2 025 |
| Coefficient of drape | 0.9604 | 0.9635 | 0.898 | 0.9712 | 0.97 |
| Abrasion resistance (cycles) | 540 | 1 072 | 497 | 1 312 | 2 000 |

For Example 2, the residual deformation with time was measured after elongation under a load of 5 daN. The table below indicates the results.

| | Elongation under 5 daN, % | Residual deformation (elongation in %) time zero | after 5 min. | 20 min. | 1 h | after 24 h |
|---|---|---|---|---|---|---|
| Example 2 needle-bonded untreated longitudinal direction | 11 | 5.8 | 5.2 | 4.6 | 4 | 3.6 |
| transverse direction | 16.3 | 10.8 | 9.2 | 8.3 | 8 | 7.5 |
| Example 2 treated longitudinal direction | 7.5 | 0 | 0 | 0 | 0 | 0 |
| transverse direction | 12.1 | 0 | 0 | 0 | 0 | 0 |

For Example 2, the residual deformation with time was also measured after mechanical fatigue of 50 cycles; the results are indicated in the table below.

| | | Residual deformation (elongation in %) time zero | after 5 min. | 20 min. | 1 h | after 24 h |
|---|---|---|---|---|---|---|
| Example 2 needle-bonded untreated | longitudinal direction | 7.8 | 7.4 | 7.3 | 7.2 | 6.2 |
| | transverse direction | 12 | 11.6 | 11.6 | 11.6 | 11.2 |
| Example 2 treated | longitudinal direction | 3.9 | 3 | 3 | 2.5 | 1.6 |
| | transverse direction | 4.4 | 3.9 | 3.7 | 3.2 | 2.3 |

What is claimed is:

1. A process for producing spunbonded non-woven textile sheet of continuous filaments of polyester and continuous filaments of polyamides which comprises forming a spunbonded non-woven sheet of crimped continuous side-by-side polyester/polyamide filaments, said sheet having an overall linear density of less than 2 dtex;

needle bonding the spunbonded non-woven sheet using needles of gauge 38 to 42 possessing 2 to 3 barbs per needle, said barbs each being smoothed on 2 to 3 edges so that the number of perforations is in the range of from 100 to 1500 perforations per square centimeter;

contacting the needle bonded spunbonded sheet at a temperature of from 5° C. to 40° C. with an aqueous solution of a swelling agent consisting of formic acid at a concentration of from 50 to 70% whereby the sheet is contracted and the side-by-side filaments are at least partially separated into the continuous polyamide filaments and the continuous polyester filaments, each of said separated filaments having a denier of less than 1 dtex.

2. The process of claim 1 wherein the needles are of gauge 40 to 42 and the number of perforations is between 400 and 800 per square centimeter.

3. The process of claim 1 wherein the concentration of the formic acid is from 55 to 65%.

4. The process of claim 3 wherein the temperature in the contacting step is from about 18° to 25° C.

5. The process of claim 4 wherein the polyamide is a polycondensation product of hexamethylene diamine and adipic acid, and the polyester is a polyethylene glycol terephthalate.

6. The process of claim 1 wherein the polyamide is a polycondensation product of hexamethylene diamine and adipic acid, and the polyester is a polyethylene glycol terephthalate.

7. A needle bonded non-woven textile sheet comprising polyamide filaments and polyester filaments wherein said filaments have a denier of less than 1 dtex, said sheet weighing from 40 to 400 g/m$^2$, having a tear strength of more than 25 g/m$^2$, a flexular strength of from 300 to 2500 mg/cm of width, an abrasion resistance of more than 500 cycles, a residual deformation with time, under an elongation load of 5 daN, which is in a ratio of from 1 to 4, as compared to a needle-bonded sheet of the same weight, after mechanical fatigue of 50 cycles, and a zero residual deformation with time after simple elongation under a load of 5 daN.

8. The non-woven sheet of claim 7 which is produced by needle bonding a non-woven sheet of crimped continuous side-by-side polyester/polyamide filaments and having an overall linear density of less than 2 dtex, with the number of perforations being in the range of from 100 to 1500 per square centimeter, and contacting the needle bonded sheet at a temperature of from 5° C. up to about 40° C. with an aqueous solution of formic acid in a concentration of 50 to 70% whereby the sheet is contracted and the side-by-side filaments are at least partially separated into the continuous polyamide filaments and the continuous polyester filaments.

9. The non-woven sheet of claim 8 wherein the non-woven sheet is needle bonded using needles of gauge 38 to 42 possessing 2 to 3 barbs per needle, said barbs each being smoothed on two to three edges.

10. The non-woven sheet of claim 7 wherein the polyamide is a polycondensation product of hexamethylene diamine and adiptic acid and the polyester is a polyethylene glycol terephthalate.

* * * * *